United States Patent [19]

Bareis et al.

[11] Patent Number: 4,716,800

[45] Date of Patent: Jan. 5, 1988

[54] INSTALLATION FOR CORRECTLY STACKING BLANKS

[75] Inventors: Alfred Bareis, Uhingen; Karl Dangelmaier; Horst Pfisterer, both of Goeppingen, all of Fed. Rep. of Germany

[73] Assignee: L. Schuler GmbH, Goeppingen, Fed. Rep. of Germany

[21] Appl. No.: 889,841

[22] Filed: Jul. 28, 1986

[30] Foreign Application Priority Data

Jul. 27, 1985 [DE] Fed. Rep. of Germany ..... 3527018

[51] Int. Cl.[4] ..... B26D 7/32; B30B 15/32

[52] U.S. Cl. ..... 83/91; 83/95; 83/97

[58] Field of Search ..... 83/89-95, 83/97, 157, 167, 698, 158

[56] References Cited

U.S. PATENT DOCUMENTS

| | | | |
|---|---|---|---|
| 2,281,439 | 4/1942 | Heftler | 83/91 X |
| 3,570,342 | 3/1971 | Mundt | 83/95 X |
| 3,842,698 | 10/1974 | Fitch et al. | 83/91 X |
| 4,089,242 | 5/1978 | Gramling | 83/95 |
| 4,108,031 | 8/1978 | Dangelmaier et al. | 83/95 X |
| 4,111,086 | 9/1978 | Dangelmaier | 83/90 |
| 4,197,772 | 4/1980 | Anderson et al. | 83/95 X |

FOREIGN PATENT DOCUMENTS

| | | | |
|---|---|---|---|
| 2121578 | 8/1972 | France | 83/95 |

*Primary Examiner*—E. R. Kazenske
*Assistant Examiner*—Hien H. Phan
*Attorney, Agent, or Firm*—Barnes & Thornburg

[57] ABSTRACT

For reducing the refitting time of high-speed presses as a consequence of the adaptation of the distances of stacking spindle and support members to the dimensions of the cutting tool to be interchanged and of the blank, the stacking spindle and the support members are arranged on interchanging rails adapted to be displaced out of the press table. Upon reaching the required height of the stack, the spindle tip adapted to be separated from the stacking spindle is held by a retaining device consisting of adjusting means and slide member so that the stack can be lowered to the discharge conveyor plane.

8 Claims, 8 Drawing Figures

INSTALLATION FOR CORRECTLY STACKING BLANKS

The present invention relates to an installation for the correct stacking of blanks made by the multiple press tool method with a stacking spindle for each stacking channel which is adapted to be raised and lowered by way of a support mechanism and is guided from below through the press table into the lower part of the cutting tool, and in which the stacking spindle includes a spindle tip which remains within the area of the intermediate stack formation when the stacking spindle is lowered below the conveyor plane of a transporting means extending at least underneath the stacking spindle, and with a mechanism for the intermediate stack formation.

In high-speed presses with multiple cutting tools for cutting or punching out sheet metal blanks of electrical machines, possibly also for electric transformers, the cut parts or blanks are conducted downwardly out of the cutting tool and thereafter laterally out of the high-speed press. It is thereby necessary that the cut parts or blanks are stacked corresponding to the sectional view. If the stacking takes place in stacking channels underneath the lower part of the cutting tool, stacking spindles are necessary within this area for the formation of the stacks as well as intermediate stacking assists, the latter in order to enable an uninterrupted operation of the high-speed press.

An installation of the aforementioned type is disclosed in U.S. Pat. No. 4,108,031. In the installation disclosed therein, the blanks made according to the multiple press tool method are adapted to be stacked on a stacking spindle in a stacking channel through the matrix or bottom die of the cutting tool. The stacking spindle is provided with a spindle tip which is kept at the stacking height during the formation of an intermediate stack. For supporting the lowest blank of the stack, a retaining device is temporarily displaced into the stacking channel. The stacking spindle is separated from the spindle tip during the lowering of the stack disposed on the stacking spindle and is lowered underneath the conveyor plane for the stacks. During the operation, the blanks fall on a liftable and lowerable stacking table with simultaneous noise development, the same being true also for the intermediate stacks, and the adjustment and setting-up of the stacking table and stacking spindles to a new work tool set to be interchanged is complicated because the free space necessary therefor is not always available in the press.

The principal object of the present invention resides in the creation of an installation of the known type which is more easily adapted to a new cutting tool to be interchanged and whereby cutting tools or punching dies with cutting stations which are arranged very far from one another can be used.

The underlying problems are solved according to the present invention in that support members are provided which extend in the direction of the stacking spindle and spindle tip and support the lowest blank stacked on the spindle tip, in that the diameter of the stacking spindle is smaller than the diameter of the associated spindle tip, and in that the support members and the stacking spindle are interchangeable and are secured at the support mechanism adjustable in relation to the new cutting tool.

It is thereby of advantage that the stacking spindle as supporting element of the spindle tip as well as the support members essentially only have to be adjusted but need not be completely exchanged.

According to a further feature of the present invention, the stacking spindle and support members are adapted to be adjusted outside of the press whereby the space required anyhow by the chain conveyor is utilized for moving the interchanging rails out of the press. In presses with facilitated access to the comb-like support installation in the press table, it is of advantage to adjust the stacking spindle and support members directly in guide grooves of the supporting installation.

In an advantageous further development of the present invention, an expansion sleeve serves as device for the intermediate stack formation, whereby the free fall of the blanks in the stacking channel is adapted to be braked and also other forms of blanks can be stacked in an intermediate manner. The spindle tip can thereby be dispensed with.

These and other objects, features and advantages of the present invention will become more apparent from the following description when taken in connection with the accompanying drawing which shows, for purposes of illustration only, several embodiments in accordance with the present invention, and wherein.

Figure 1:
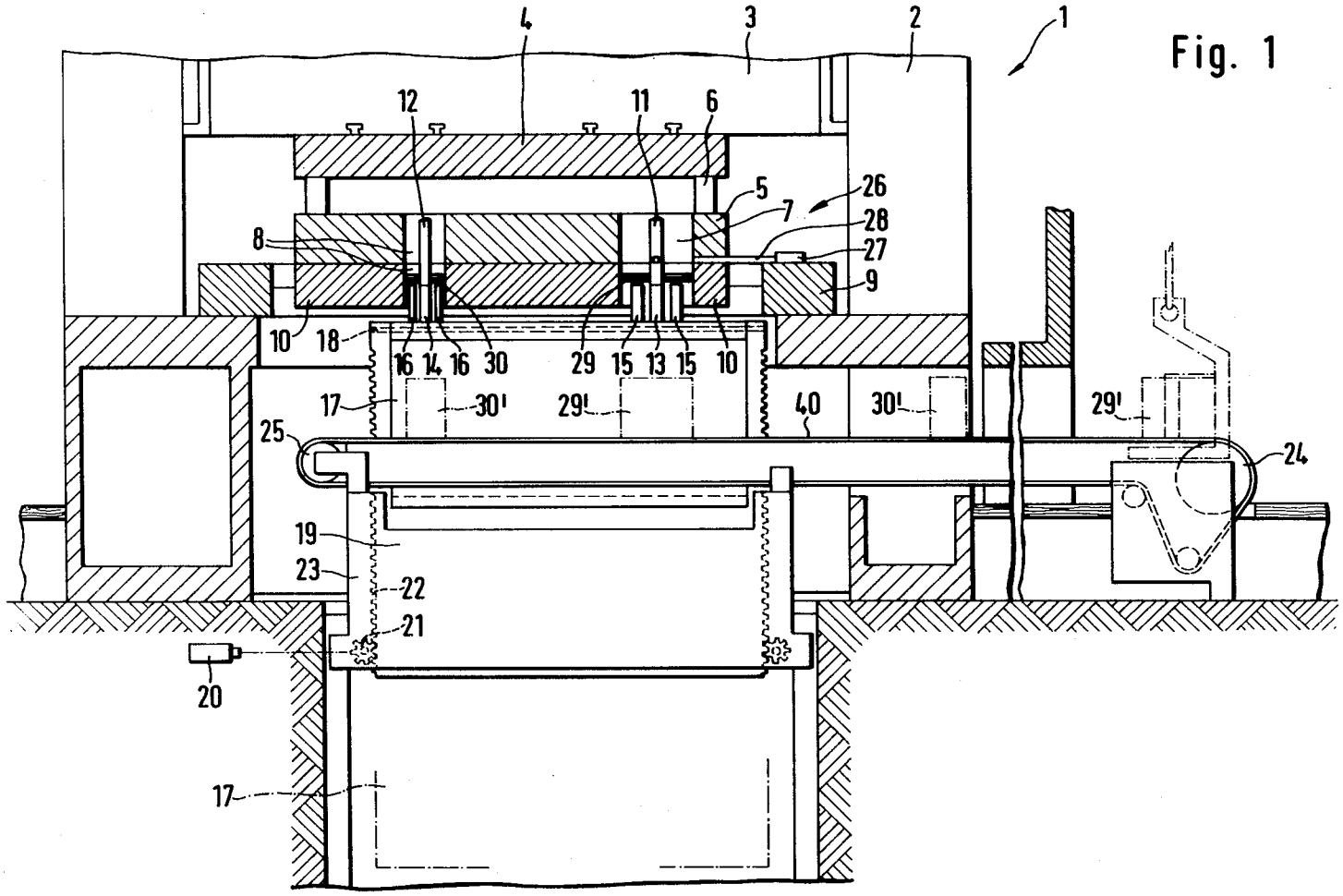
FIG. 1 is a schematic elevational view, partly in cross section, of the work-tool-, stacking- and conveyor area in a high-speed press according to the present invention.
Figure 2:
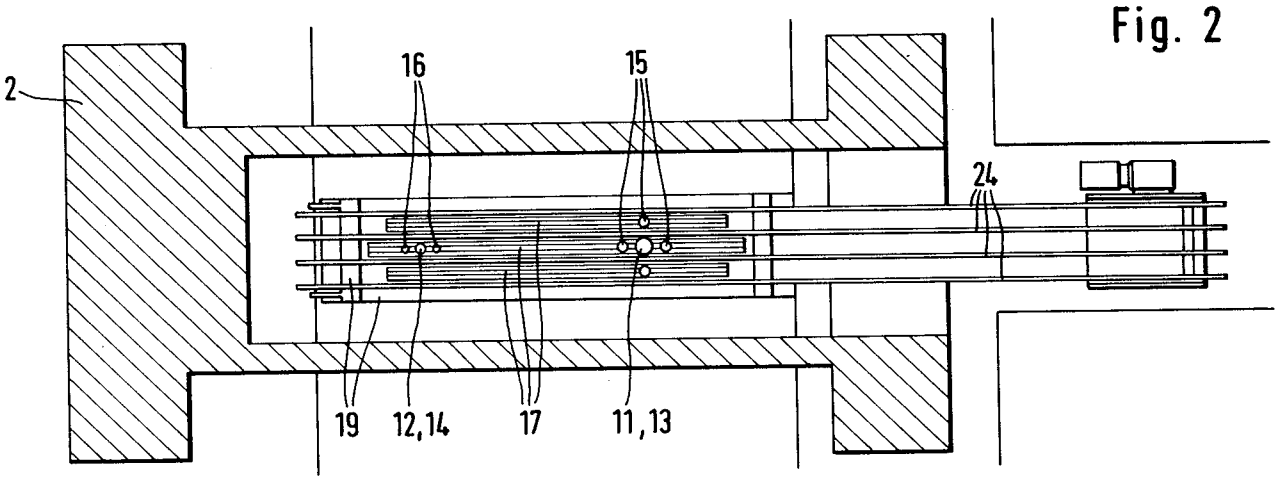
FIG. 2 is a plan view on the chain conveyor and the support installation in accordance with the present invention.
Figure 3:
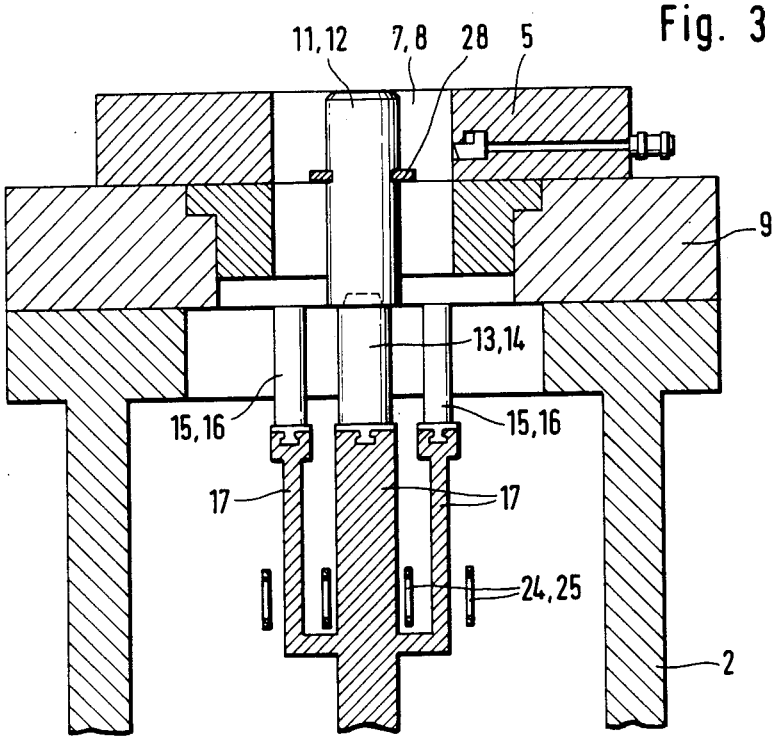
FIG. 3 is a cross-sectional view through a stacking area of the high- speed press in accordance with the present invention.
Figure 4:
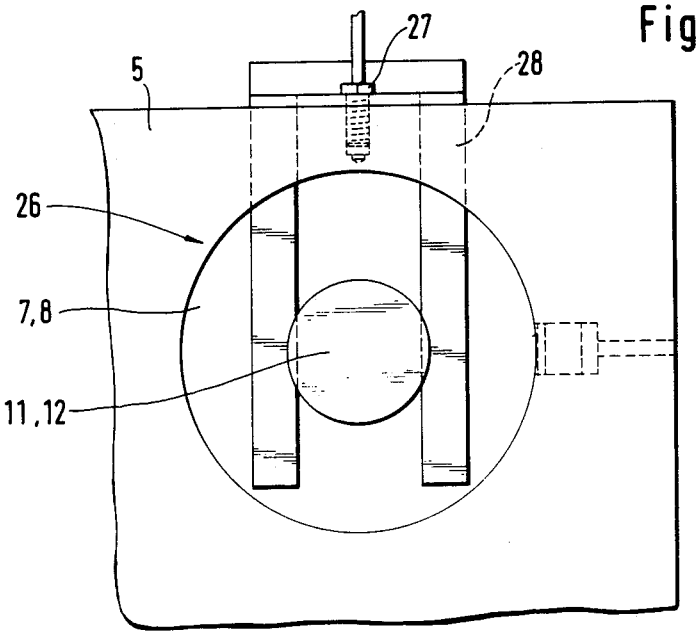
FIG. 4 is a plan view on a device for intermediate stacking in accordance with the present invention.

Referring now to the drawing wherein like reference numerals are used throughout the various views to designate like parts, and more particularly to FIG. 1, the high-speed press generally designated by reference numeral 1 includes a press frame 2, a ram 3 adapted to be raised and lowered, a press table 9, a clamping plate 10 resting on the press table 9, and an interchangeable cutting or punching tool consisting of the upper part 4 and of the lower part 5 with column guidances 6. One stacking channel 7 and 8 each for the passage of the cut parts or blanks in the downward direction are provided in the lower part 5 of the cutting tool as well as in the clamping plate 10 within the area of each cutting stage. A stacking spindle 13 and 14 is arranged centrally with respect to each stacking channel 7 and 8 which are carried by a support installation 17. One spindle tip 11 and 12 each is coordinated to the stacking spindles 13 and 14; the spindle tips 11 and 12 must correspond in diameter to the inner diameter of the cut parts or blanks in the stacks 29 and 30. The spindle tips 11 and 12 are arranged coaxially to the stacking spindles 13 and 14 and above the same. During the operation of the high-speed press 1 the spindle tips 11 and 12 are assisted by the stacking spindles 13 and 14 whereas during the intermediate stack formation the spindle tips 11 and 12 are retained by an installation for the intermediate stack formation generally designated by reference numeral 26 (FIGS. 3 and 4). The support installation 17 carries additionally support members 15 and 16 which are initially placed against the bottom side of the first blank produced by the cutting tool 4 and 5. The stacking spindles 13 and 14 and support members 15 and 16 are liftable and lowerable by means of the support installation 17. Motors 20 serve for this purpose which engage at the support installation 17 displaceable in the press frame 19 within guidances 23 by way of a gear 21 engaging with a toothed rack 22 in the corner areas. As can be seen in particular from FIGS. 3 and 7, the support installation 17 has a comb-like shape in order to extend with the thus upwardly projecting areas thereof supporting the stacking spindles 13 and 14 and support members 15 and 16 through the free spaces between the chains of a conveyor means 24 constructed as chain conveyor. In order to indicate that the chain conveyor 24 is extended up to underneath the area of the stacking spindle 14 located in the left part of the drawing, the reversing roller which is located remote from the driving side of the chain conveyor 24, is designated by reference numeral 25 in FIG. 1. If both the stator sheet metal part as also the rotor sheet metal part of an electric motor is cut out of a sheet metal blank, then the installations for the stacking and intermediate stacking, as is shown in FIG. 1, are to be provided twice with dimensions correspondingly matched to each cut part or blank. The lowered and removable stacks are designated by reference numerals 29' and 30'. The conveyor plane, below which the stacking spindles 13 and 14 and together with the latter the support members 15 and 16 are to be lowered, is designated in FIG. 1 by reference numeral 40. The lowered position of the support installation 17 is indicated in FIG. 1 in dash and dotted lines.

The support function of the device generally designated by reference numeral 26 (FIG. 1) for the intermediate stack formation, can be seen more clearly in FIGS. 3 and 4. The device 26 includes a slide member 28 movable by an adjusting means 27 and operable to engage in grooves 33 (FIGS. 5 and 6) of the spindle tips 11 and 12 in order to prevent the latter from being lowered. Furthermore, the cut parts or blanks accumulate on the slide member 28 into an intermediate stack when the stacks 29 and 30 (FIG. 1) are lowered.

Figure 7:
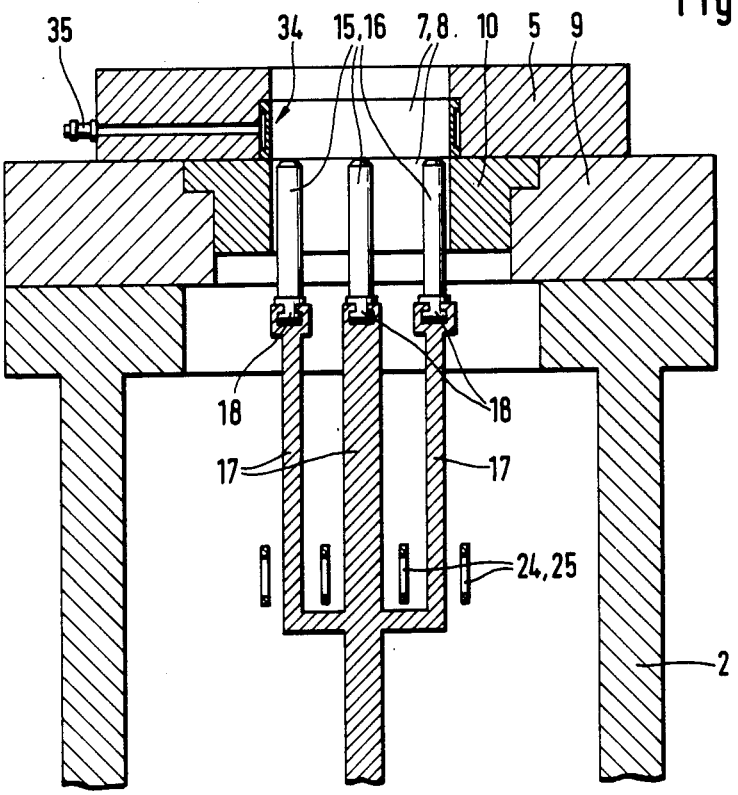
FIG. 7 is a cross-sectional view through a modified embodiment of a stacking area of a high-speed press in accordance with the present invention.
Figure 8:
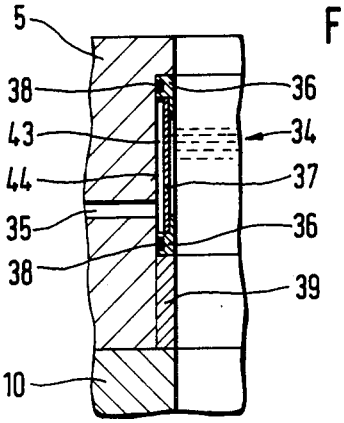
FIG. 8 is a partial cross-sectional view through a modified embodiment of a device for the intermediate stack formation.

A further possibility for the intermediate stack formation can be seen in FIGS. 7 and 8. Support members 15 and 16 serve for the spindless support of the blanks dropping out of the lower part 5 of the cutting tool 4, 5, whereby these support members extend up to the bottom surface of the lower part 5 of the cutting tool 4, 5. A retaining device generally designated by reference numeral 34 and essentially consisting of an expanding sleeve 37 that is held by clamping rings 36 serves thereby for the intermediate stack formation during the lowering of the support members 15 and 16. The pressure space 43 which is thus formed between the expanding sleeve 37 and the wall 44 in the lower part 5 of the cutting tool 4, 5 is closed off by sealing rings 38 and is in communication with a pressure line 35. With a pressure increase in the pressure space 43, the expanding sleeve 37 buckles inwardly into the cross section of the stacking channel 7, 8. Reference numeral 39 designates a spacer sleeve.

Figure 6:
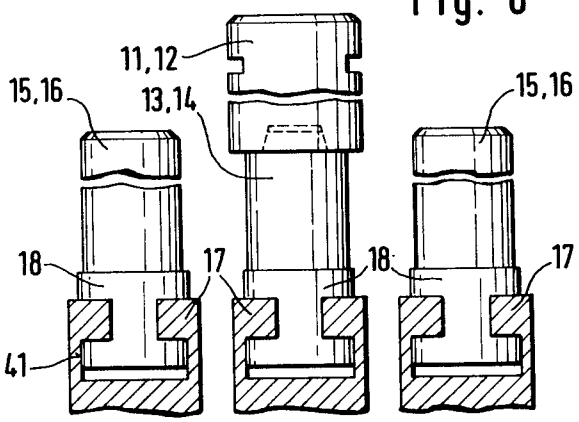
FIG. 6 is an elevational view of a modified embodiment of a stacking spindle and support members in accordance with the present invention.
Figure 5:
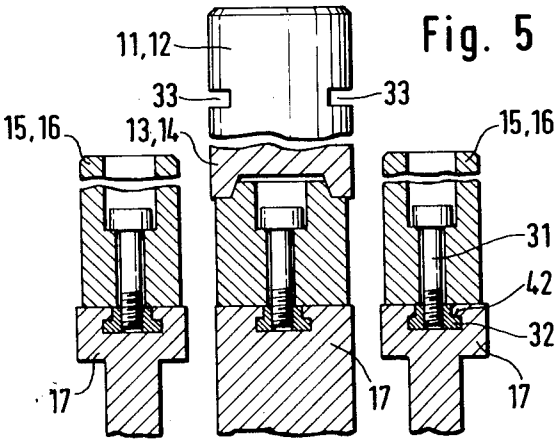
FIG. 5 is an elevational view, partly in cross section, of parts illustrated in FIG. 3.

FIGS. 5 and 6 further illustrate the different fastening possibilities of stacking spindles 13 and 14 and support members 15 and 16. These means may be secured at the support installation 17 either directly by means of bolts 31 and clamping nuts 32 in guide grooves 42 of the support installation 17 (FIG. 5) or indirectly by way of interchange rails 18 in the support installation 17 (FIG. 6). The interchange rails 18 are displaceable in guide grooves 41 of the support installation 17 and are so supported as to be fixed during the press operation.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An arrangement for sectionally correctly stacking blanks made by multiple press tool methods, comprising:

a press table;

cutting tool means having cutting tool upper and lower parts;

a plurality of stacking channels having one stacking spindle means per stacking channel;

a conveyor means having a conveying plane and extending at least to underneath the stacking spindle means;

means for intermediate stack formation in an intermediate area between said cutting tool means and said conveyor means;

support installation for raising and lowering said stacking spindle means between a position extending through the press table from below into the lower part of the cutting tool means and a position below said conveying plane;

each stacking spindle means including a spindle tip means which remains within the intermediate area when the stacking spindle means is lowered toward said conveying plane, and support means which extend in the direction of the stacking spindle means and spindle tip means for supporting the lowermost blank stacked on the spindle tip means;

a diameter of the stacking spindle means being smaller than a diameter of the associated spindle tip means and said support means and said stacking spindle means being interchangeably and adjustably secured to the support installation as to be interchanged and adjustable in position for a new cutting tool means.

2. An installation according to claim 1, wherein the stacking spindle means and the support means are interchangeably supported at the support installation on interchanging rails means.

3. An installation according to claim 2, wherein the conveyor means is a chain conveyor having a plurality of chains with free spaces therebetween, and wherein the interchanging rail means for the stacking spindle means and the support means are supported in the longitudinal direction of the chain conveyor on a comb-like support installation adapted to be extended through the free spaces between the chains of the chain conveyor.

4. An installation according to claim 3, wherein the interchanging rail means are supported in guide means at the support installation and are removable from the press in the longitudinal direction of the chain conveyor.

5. An installation according to claim 1, wherein each stacking spindle means and the support means are operable to be directly secured at the support installation in guide grooves by way of threaded fastening means.

6. An installation according to claim 1, wherein the means for the intermediate stack formation is formed by a retaining means provided in the lower part of the cutting tool means, said retaining means including an expanding sleeve and a pressure space that is formed essentially by the expanding sleeve and walls of an inner recess in the lower part of the cutting tool means.

7. An installation according to claim 1, wherein said support means and stacking spindle means are interchangeable and adjustable in a plane parallel to said conveying plane.

8. An installation according to claim 1, wherein the means for the intermediate stack formation is formed by a retaining means provided in the lower part of the cutting tool means.

* * * * *